United States Patent [19]

Reinhall

[11] 4,118,800

[45] Oct. 3, 1978

[54] DEVICE FOR USE IN BEATING OR REFINING MACHINES

[76] Inventor: Rolf Bertil Reinhall, 834 171st. Pl. NE., Bellevue, Wash. 98008

[21] Appl. No.: 762,180

[22] Filed: Jan. 24, 1977

[30] Foreign Application Priority Data

Jan. 30, 1976 [SE] Sweden ..... 76010180

[51] Int. Cl.[2] ..... B01F 7/00

[52] U.S. Cl. ..... 366/341; 366/244; 366/262

[58] Field of Search ..... 259/5, 21, 40, 95, 9, 259/102, 115, DIG. 16, DIG. 30, 6, 22, 23, 24

[56] References Cited

U.S. PATENT DOCUMENTS

| | | | |
|---|---|---|---|
| 1,489,786 | 4/1924 | Povey | 259/DIG. 30 |
| 2,441,711 | 5/1948 | McFadden | 259/6 |
| 2,477,929 | 8/1949 | Hetherington | 259/95 X |
| 3,752,489 | 8/1973 | Latineh | 259/DIG. 16 |
| 3,921,962 | 11/1975 | Feger | 259/DIG. 16 |

*Primary Examiner*—Edward J. McCarthy
*Attorney, Agent, or Firm*—Eric Y. Munson

[57] ABSTRACT

Sealing device for preventing leakage of pressurized medium from the housing of a defibrator, refiner and the like, in which lignocellulosic pulp material is ground between two grinding discs, one of which is mounted on a drive shaft to rotate relative to the other within the pressurized housing. The sealing device comprises a pump having a stationary housing sealed to the defibrator housing and spaced from the drive shaft to define a gap extending into the interior of the defibrator housing. The pump impellers are mounted to rotate with the drive shaft to pump a sealing fluid to a pressure higher than that prevailing within the defibrator housing and propel the thus pressurized fluid through the gap into the defibrator housing to thereby prevent leakage of the pressurized medium through the drive shaft opening in the defibrator housing.

9 Claims, 2 Drawing Figures

DEVICE FOR USE IN BEATING OR REFINING MACHINES

FIELD OF THE INVENTION

The present invention is concerned with a device for use in defibrating or refining machines for fibrous and/or organic materials, including a defibrator housing which is maintained at a pressure greater than atmospheric and encloses two grinding discs mounted to rotate with respect to one another, at least one of the discs being supported by the defibrator drive shaft which passes through an opening in the defibrator housing with a sealing device fitted between the shaft and the housing.

BACKGROUND OF THE INVENTION

A problem with defibrating apparatus of the type described is sealing the point where the shaft passes through the defibrator housing. Many solutions have been proposed, the most common one being to apply a packing material where the shaft passes through the housing, which material is pressed tightly against the drive shaft or against bearing surfaces on the shaft. These conventional seals have many drawbacks, however, the most important one being the substantail generation of heat, which may readily lead to overheating of the seal.

SUMMARY OF THE INVENTION

The main purpose of the invention is to provide a sealing device for use in grinding apparatuses, refiners and the like, by which the above drawbacks are eliminated. This is achieved by designing the device as a pump, preferably of the multistage type, having its impellers fixed on the shaft to rotate therewith and enclosed in the pump housing which has a flange surrounding the shaft at a spaced distance therefrom which extends to engage a bearing surface located inside the defibrator housing. Thus, as the shaft rotates, the fluid pumped up to a pressure greater than that which prevails inside the refiner housing is propelled through the gap between the flange and the shaft and against the seal, thus preventing any leakage from the opening in the beater housing through which the shaft passes.

A further, special purpose of the invention is to produce a device which will solve the problems that arise when the defibrator shaft is mounted so that it can be displaced axially in order to adjust the disc clearance during operation, when it is necessary to ensure that the impellers and the pump housing do not change their relative positions as the shaft is moved.

BRIEF DESCRIPTION OF THE DRAWINGS

The solutions of this and other problems will be apparent from the following claims and from the further description of an embodiment presented as an example and illustrated in the accompanying drawings.

DESCRIPTION OF A PREFERRED EMBODIMENT

Figure 1:
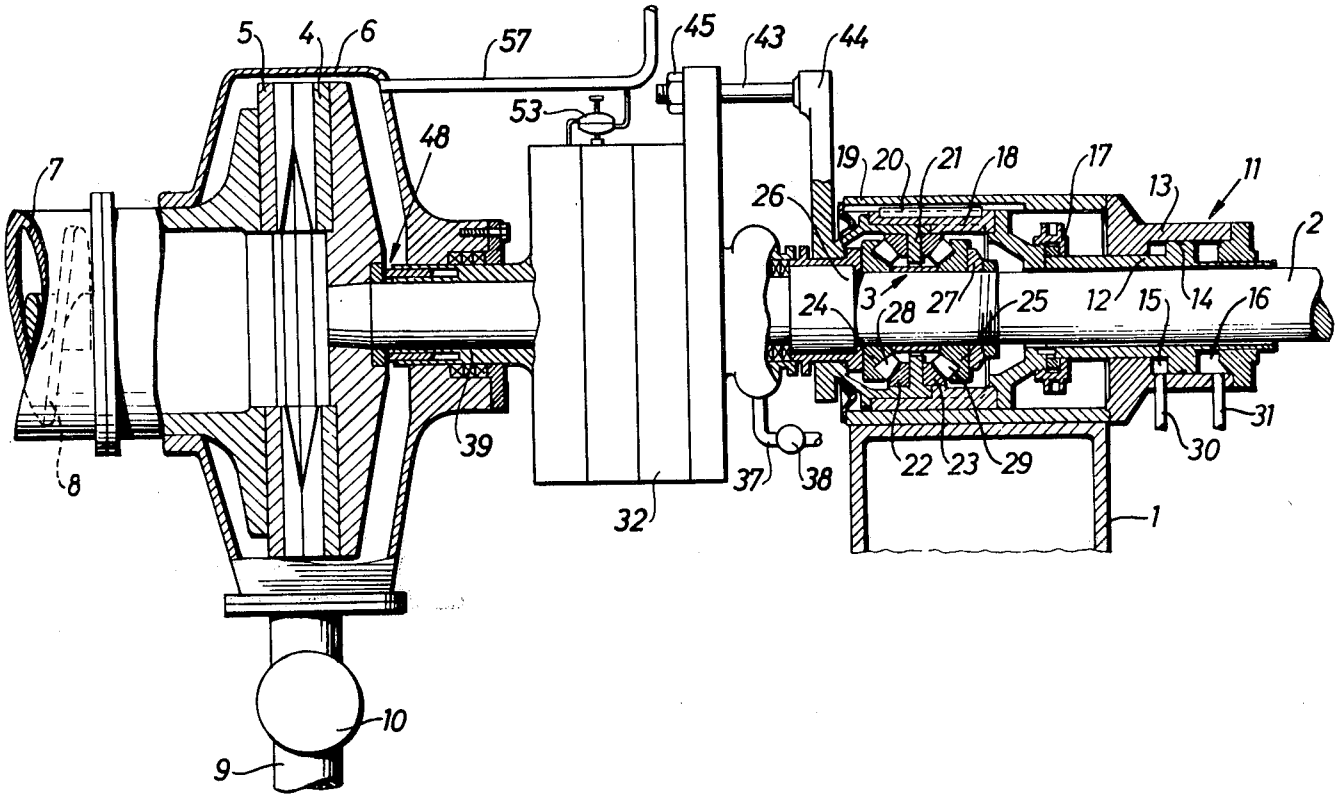
FIG. 1 shows a side elevation, partly in section, of a grinding apparatus which is known per se and which is equipped with the device of the invention.

As appears from FIG. 1, the new device is illustrated in combination with a grinding apparatus which is known per se, and only such parts of the latter as are essential to the present purpose are shown. The grinding apparatus may be a defibrator or a refiner, preferably for processing ligno-cellulose-containing materials.

The reference number 1 denotes part of the defibrator frame, which supports a shaft 2. The bearing elements used for the shaft 2 are double radial thrust bearings, and a bearing 3 of this type is shown in the drawing. One end of the shaft 2 is connected to a drive motor (not shown). The other end of the shaft 2 supports a grinding disc 4, and along with this disc the shaft is axially adjustable with respect to a second, stationary grinding disc 5. The two discs 4, 5 are enclosed in a grinding housing 6, and the material (pulp) to be ground enters through a centrally located axial duct 7. The pulp is propelled through the duct by a feed screw 8 and subjected to the action of grinding surfaces formed in a manner known per se on the facing surfaces of the discs 4, 5. After having been subjected to the action of the discs 4, 5, the ground pulp is passed out via discharge duct 9 equipped with a regulating valve 10.

A servomotor 11 is positioned concentrically about the shaft 2. The servomotor comprises an axially displaceable cylindrical piston 12. However, the piston 12 is not free to rotate in its stationary casing 13. The piston 12 is provided with a flange 14 which divides a cylindrical space inside the casing 13 into two separate chambers 15, 16.

The piston 12 is rigidly connected via a coupling 17 to the housing 18 of the bearing 3. The bearing housing 18 is slidable axially in a stationary outer housing 19 which is supported by the frame 1 but prevented from rotating with respect to the latter by a key 20 or the like.

The bearing housing 18 contains a central bearing unit 21 in which are fitted two non-rotating bearing rings 22, 23. Fitted on the shaft 2 are two more bearing rings 24, 25, which rotate with the shaft 2 but are axially fixed on the latter between a flange 26 and a screw fitting 27. The bearing rings are provided with oppositely disposed bearing surfaces which incline towards each other and designed to interact with rollers 28, 29. Consequently, the bearing 3 is capable of transmitting axial thrust in both directions and also of absorbing radial loads from the shaft 2.

A hydraulic pressure medium, such as oil, can be fed into the chambers 15, 16 of the servomotor 11 via ducts 30, 31 respectively in a manner known per se.

Between the defibrator housing 6 and the bearing housing 18, 19 in the embodiment illustrated (FIG. 2), three impellers 33, 34, 35 are mounted in series on the shaft 2 and enclosed in a pump housing 32 so designed that the impellers 33–35 rotating therewithin work together in a known manner to build up a pressure higher than the in-flow pressure in the inlet duct 36, to which a fluid, e.g., water, if fed via a pipe 37 and a valve 38. The flange 39 of the pump housing 32, facing the defibrator housing 6, is sealed off from the housing 6 by means of a slidable seal or stuffing box 40 in a manner known per se so that the pump housing 32 can move in an axial direction with respect to the defibrator housing 6. For this purpose, an adjustable bolt joint consisting of a flange 41 and bolts 42 is used to adjust the stuffing box 40 between the pump housing 32 and the defibrator housing 6. The part of the pump housing 32 facing the double radial thrust bearing housing 18 is rigidly coupled to the latter by means of an extension unit 43, e.g., via an arm 44 on the bearing housing 18. The joint can be made by e.g. a threaded bolt and nut 45.

As can be seen from FIG. 1, when the above-mentioned pressure medium is fed into the chamber 16 via the duct 31, the piston 12 will be displaced to the left of the figure, and hence the rotating disc 4 will be moved towards the stationary disc 5. The chamber 15 is then not pressurized. By resetting a valve (not shown), the pressure medium may alternatively be fed into the chamber 15 via the duct 30, while the chamber 16 is connected to an oil sump (not shown). The disc 4 is then moved away from the stationary disc 5. Servomotors of this type are known, e.g. from Swedish Letter of Patent 179,336. Inasmuch as the pump housing 32 is rigidly coupled to the bearing housing 18 via the extension 43, and the impellers 33–35 are rigidly connected to the shaft 2 and moved along with the shaft 2 when the latter is displaced in either direction, as are also the bearing housing 18 and the extension 43, it follows that the impellers 33–35 inside the pump housing 32 will always be in the same position in the pump housing, and hence the sealing tolerance in the pump housing 32 will not be disturbed.

Figure 2:
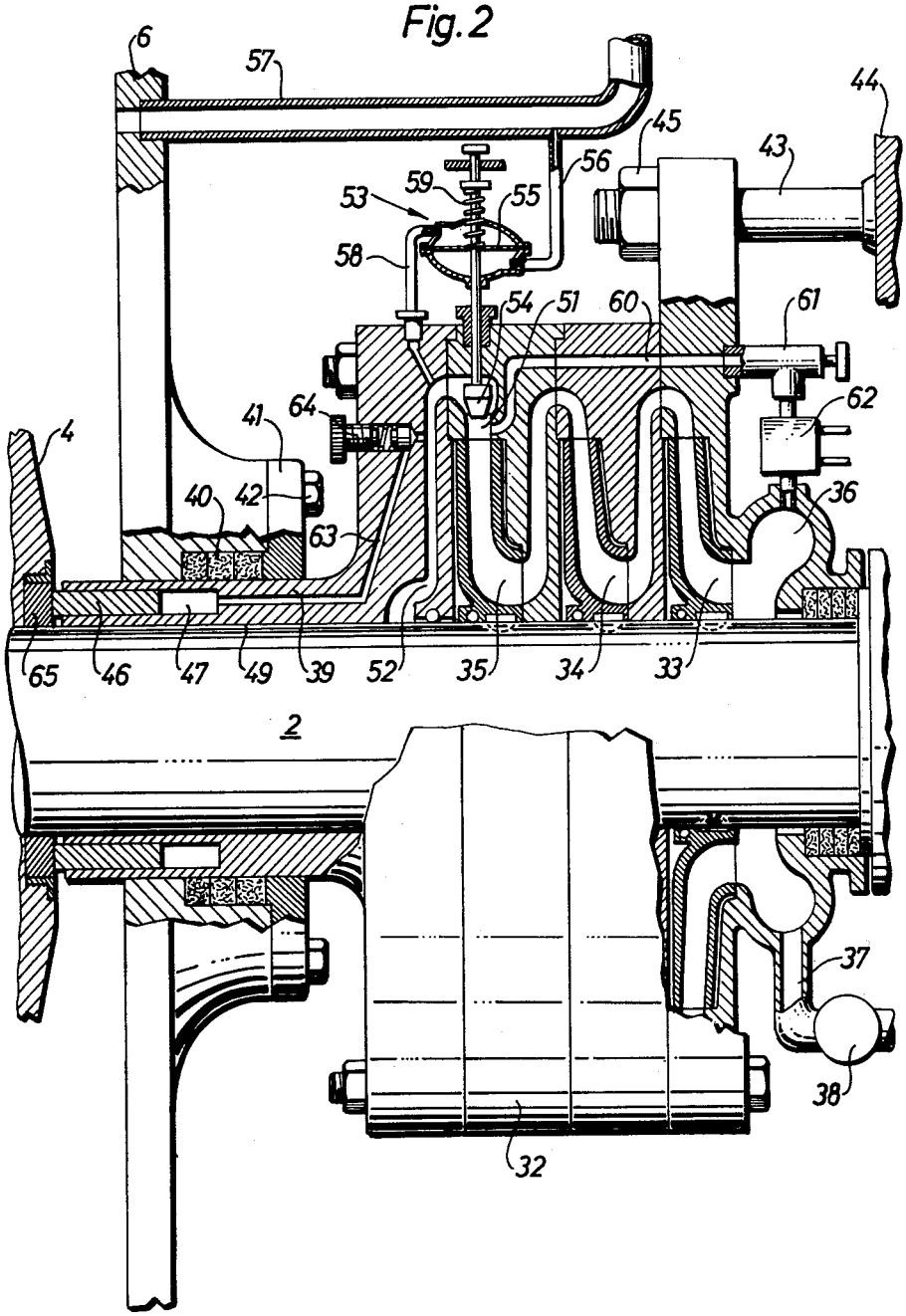
FIG. 2 shows, on a larger scale, a section through the device located between the grinding housing and the bearing housing in FIG. 1, the design of the pump housing being somewhat modified from that in FIG. 1.

In the embodiment illustrated in FIG. 2, that end of the flange 39 of the pump housing 32 which faces the defibrator housing 6 is fitted with an annular piston 46 which reciprocates in an annular cylinder chamber 47. The piston bears against the central portion of the disc 4, and is provided with passages (not shown) through which the sealing fluid in the annular gap 49 around the shaft 2 communicates with the interior of the defibrator housing 6.

The outlet duct 51 of the impeller 35 nearest the defibrator housing 6 communicates via a duct 52 with the sealing chamber 49, and between the outlet ducts 51 and 52 is connected a pressure regulator 53 containing a valve cone 54 coupled to a diaphragn 55 which divides the regulator into two halves. One half of the regulator housing communicates via a pipe 56 with a steam line 57 coming from the grinding housing 6 and is subjected to the same pressure as the interior of the latter, while the other half of the regulator housing communicates via a pipe 58 to the outlet duct 52. The valve cone 54 is loaded with an adjustable spring 59 to allow the regulator setting to be changed. In this way, the pressure regulator can be set to keep the pressure in the outlet duct 52 at the desired level above that maintained in the grinding housing 6, as is necessary to ensure a suitable, limited inflow of sealing fluid from the chamber or gap 49 through the passages and into the beater housing 6. Ahead of the valve cone 54, a recirculation duct 60 branches off the outlet duct 51 from the last impeller 35 and leads back via a reducing valve 61 to the inlet duct 36. If necessary, a heat exchanger 62 can be introduced in the duct 60 between the valve 61 and the inlet duct 36 to cool the recirculated fluid to the desired temperature.

The device of the invention described above functions as follows: when a fluid, preferably water, is supplied via the feed pipe 37 to the intake duct 36 and from there is progressively pumped by the impellers 33–35 to a pressure exceeding that maintained in the defibrator housing 6, the quantity of fluid transported by the pump will — if the regulator 53 has closed off the opening to duct 52 — be recirculated to the intake duct 36 via the recirculation duct 60 and the reducing valve 61, which keeps the operating pressure in the pump housing at a constant, controllable level.

When the regulator 53 is actuated, the valve cone 54 will open and the fluid will flow out into duct 52, which leads to the annular chamber 49 around the shaft 2. When the pressure in the duct 52 has reached a level which is preset by means of the spring 59 and exceeds that prevailing in the defibrator housing 6, the regulator 53 will set the valve cone 54 to such a position that this pressure will thenceforth automatically follow the pressure variations in the defibrator housing 6. A small amount of the sealing fluid — which is propelled forward to the defibrator disc 4 via the shaft 2 and the annular chamber 49 under a higher pressure than that prevailing in the interior of the defibrator housing — will enter the interior of the housing 6 via the gap 48 (FIG. 1). The added liquid is thus raised to a pressure higher than that prevailing inside the defibrator housing 6 and is fed by the action of the regulator 53 via the duct 52 and the chamber 49 into the gap 48, thus preventing the atmosphere prevailing within the defibrator housing 6 from leaking out through the opening for the shaft in the housing. Leakage through the gap between the stationary flange 39 of the pump housing and the end of the defibrator housing 6 is prevented by the stuffing-box 40.

As stated, the inflow of sealing fluid into the defibrator housing 6, as required for the sealing of the latter, is made possible by the gap 48, as shown in FIG. 1. This gap can be formed, as shown in FIG. 1, by having the flange 39 end at a suitable distance from the defibrator disc 4. In this case, the width of the gap 48 can be adjusted if necessary by modifying the position of the entire pump housing 32 by adjusting the mounting 43–45 of the arm 44 on the bearing housing. It is then necessary to adjust the position of the impellers 33–35 on the shaft 2 along with the pump housing. It is to be observed that this adjustment is only required when the installation is being assembled, since subsequently the components of the pump will move along with the defibrator disc 4 and the shaft 2 when these parts undergo axial displacement.

Instead of the above described arrangement, the embodiment illustrated in FIG. 2 is provided with a piston 46 which reciprocates inside a cylinder 47. To displace the piston towards the defibrator disc, pressure medium is drawn off from the duct 52 via a duct 63 to the cylinder chamber 47, the pressure in this chamber being regulated by a reducing valve 64. As stated, the end of the piston 46 is provided with fine radial ducts (not shown) through which the sealing fluid of pressure medium from the chamber or gap 49 around the shaft can flow into the defibrator housing 6 and maintain the seal. This liquid also carries away the heat generated by friction as the grinding disc 4 rotates in frictional engagement with the stationary piston 46. A seat 65 of hard material may also be fitted on the grinding disc to reduce wear and friction.

It is evident that the embodiment illustrated is only one example of the invention and that it can be modified and altered without deviating from the terms of the invention as defined in the following claims.

I claim:

1. Sealing device for use in defibrating apparatus and the like for fibrous and/or organic materials, including a defibrator housing (6) which is maintained at a pressure greater than atmospheric and encloses two grinding discs (4, 5) mounted to rotate with respect to one another, at least one (4) of the discs being supported by a drive shaft (2) which passes through an opening in the housing, characterized by a pump enclosed within a housing (32), preferably of the multi-stage type, having its impellers (33–35) fixed on the shaft (2) and enclosed in said pump housing (32) having a flange (39) which surrounds the shaft (2) at a spaced distance therefrom so as to define a gap (49) extending into the interior of the housing, so that the fluid raised by the pump (32) to a pressure greater than that prevailing within the defibrator housing (6) is propelled through the gap (49) between said flange and the shaft and into the defibrator housing, thus preventing any leakage from the opening in the defibrator housing through which the shaft passes.

2. Device of claim 1, in which the defibrator shaft (2) is mounted so that it can be displaced axially in order to adjust the disc clearance during operation, and the pump housing (32) is coupled to the shaft (2) so that it follows the axial displacement of the latter.

3. Device of claim 1, characterized by a sealing device including a ring piston (46), which sealing device is positioned between the gap (49) and the interior of the defibrator housing and is pressed by the sealing pressure against a bearing surface which rotates with the shaft (2).

4. Device of claim 3, characterized in that the ring piston (46) reciprocates in a cylinder chamber (47) in the flange (39) of the pump housing (32), which cylinder chamber (63) communicates with the interior (52) of the pump via a pressure reducing valve (64).

5. Device of claim 3, characterized in that the end of the ring piston (46) bears on the rotating bearing surface (4, 65).

6. Device of claim 1, characterized in that the flange (39) of the pump housing (32) is provided with a bearing surface positioned to leave a gap (48) of preset width between it and the rotating bearing surface (65).

7. Device of claim 1, characterized in that the feed of sealing fluid from the pump to the gap (49) is regulated by a regulator (53) which is responsive to the pressure in the interior of the defibrator housing (6).

8. Device of claim 6, characterized by a recirculation duct (60) connected to the outlet of the pump and regulated by a pressure reducing valve (64), to draw off liquid from the pump when the feed to the gap (49) is partially or completely blocked by the regulator (53).

9. Device of claim 2, characterized in that the pump housing (32) and a bearing housing (18) which moves with the shaft (2) are joined by a coupling (43–45) which can be adjusted to regulate the width of the gap (48).

* * * * *